US011959345B2

(12) United States Patent
Alexander et al.

(10) Patent No.: US 11,959,345 B2
(45) Date of Patent: Apr. 16, 2024

(54) SEPARABLE TOOL WITH MILL FACE, METHOD AND SYSTEM

(71) Applicant: Baker Hughes Oilfield Operations LLC, Houston, TX (US)

(72) Inventors: David Alexander, Houston, TX (US); Knut Inge Dahlberg, Tomball, TX (US); Eivind Hagen, Rogaland County (NO)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/320,354

(22) Filed: May 19, 2023

(65) Prior Publication Data

US 2023/0295993 A1 Sep. 21, 2023

Related U.S. Application Data

(62) Division of application No. 17/319,403, filed on May 13, 2021, now abandoned.

(51) Int. Cl.
*E21B 23/04* (2006.01)
*E21B 10/60* (2006.01)
(Continued)

(52) U.S. Cl.
CPC ..... *E21B 23/0413* (2020.05); *E21B 10/60* (2013.01); *E21B 29/00* (2013.01);
(Continued)

(58) Field of Classification Search
CPC ..... E21B 33/13; E21B 29/00; E21B 23/06
See application file for complete search history.

(56) References Cited

U.S. PATENT DOCUMENTS 3,289,760 A * 12/1966 Kammerer ..... E21B 33/138 166/290
5,727,629 A 3/1998 Blizzard, Jr.
(Continued)

FOREIGN PATENT DOCUMENTS

EP 3085883 A1 10/2016
EP 3263829 A1 1/2018
(Continued)

OTHER PUBLICATIONS

Notification of Transmittal of the International Search Report and the Written Opinion of the International Searching Authority, or the Declaration; PCT/US2022/028506; dated Aug. 23, 2022; 7 pages.

*Primary Examiner* — Robert E Fuller
(74) *Attorney, Agent, or Firm* — CANTOR COLBURN LLP

(57) ABSTRACT

A separable tool including a mill section, a mill face disposed on the mill section and having a bore therethrough that is offset from a longitudinal axis of the mill section, a tool adapter section, and a release configuration releasably securing the mill section to the tool adapter section with the mill face disposed between the mill section and the tool adapter section. A method for operating a wellbore system including in a single run, setting a plug in the wellbore system, releasing the plug, pumping cement, dressing the cement, and testing the cement.

8 Claims, 6 Drawing Sheets

(51) Int. Cl.

| | |
|---|---|
| ***E21B 29/00*** | (2006.01) |
| ***E21B 33/13*** | (2006.01) |
| ***E21B 33/14*** | (2006.01) |
| ***E21B 47/005*** | (2012.01) |

(52) U.S. Cl.
CPC ..... *E21B 33/13* (2013.01); *E21B 33/14* (2013.01); *E21B 47/005* (2020.05)

(56) References Cited

U.S. PATENT DOCUMENTS

| | | | | |
|---|---|---|---|---|
| 6,024,169 | A | 2/2000 | Haugen | |
| 6,102,123 | A | 8/2000 | Bailey et al. | |
| 6,648,068 | B2 | 11/2003 | Dewey et al. | |
| 7,207,401 | B2 | 4/2007 | Dewey et al. | |
| 8,997,895 | B2 | 4/2015 | Swadi et al. | |
| 9,004,159 | B2 | 4/2015 | Alsup | |
| 10,227,823 | B2 | 3/2019 | Hern et al. | |
| 10,364,607 | B2 | 7/2019 | Stokes et al. | |
| 10,934,780 | B2 | 3/2021 | Pray et al. | |
| 11,421,496 | B1 | 8/2022 | Nguyen et al. | |
| 2005/0061551 | A1 | 3/2005 | DeGeare et al. | |
| 2015/0275605 | A1 | 10/2015 | Bennett et al. | |
| 2019/0257193 | A1 | 8/2019 | Telfer et al. | |
| 2020/0056446 | A1* | 2/2020 | Al-Mousa ..... | E21B 33/1293 |
| 2021/0032948 | A1 | 2/2021 | Stewart et al. | |
| 2022/0364425 | A1 | 11/2022 | Alexander et al. | |

FOREIGN PATENT DOCUMENTS

| | | | | |
|---|---|---|---|---|
| GB | 2582553 A * | 9/2020 | ..... | E21B 17/00 |
| NO | 3461345 B1 | 3/2022 | | |

* cited by examiner

SEPARABLE TOOL WITH MILL FACE, METHOD AND SYSTEM

CROSS REFERENCE TO RELATED APPLICATIONS

This application claims the benefit of an earlier filing date from U.S. Non-Provisional application Ser. No. 17/319,403 filed May 13, 2021, the entire disclosure of which is incorporated herein by reference.

BACKGROUND

In the resource recovery and CO2 sequestration industries, one of the major impediments to efficiency is the number of runs needed to accomplish various well operations. One example of the above is a plug and abandonment operation. Such operations require at a minimum running and setting a mechanical plug; cementing; and testing and tagging. And these operations generally require several runs to accomplish. Runs are expensive and time consuming. If more operations could be accomplished in a single run, efficiency would be improved and monetary recovery from the well enhanced.

SUMMARY

An embodiment of a separable tool including a mill section, a mill face disposed on the mill section and having a bore therethrough that is offset from a longitudinal axis of the mill section, a tool adapter section, and a release configuration releasably securing the mill section to the tool adapter section with the mill face disposed between the mill section and the tool adapter section.

A method for operating a wellbore system including in a single run, setting a plug in the wellbore system, releasing the plug, pumping cement, dressing the cement, and testing the cement.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
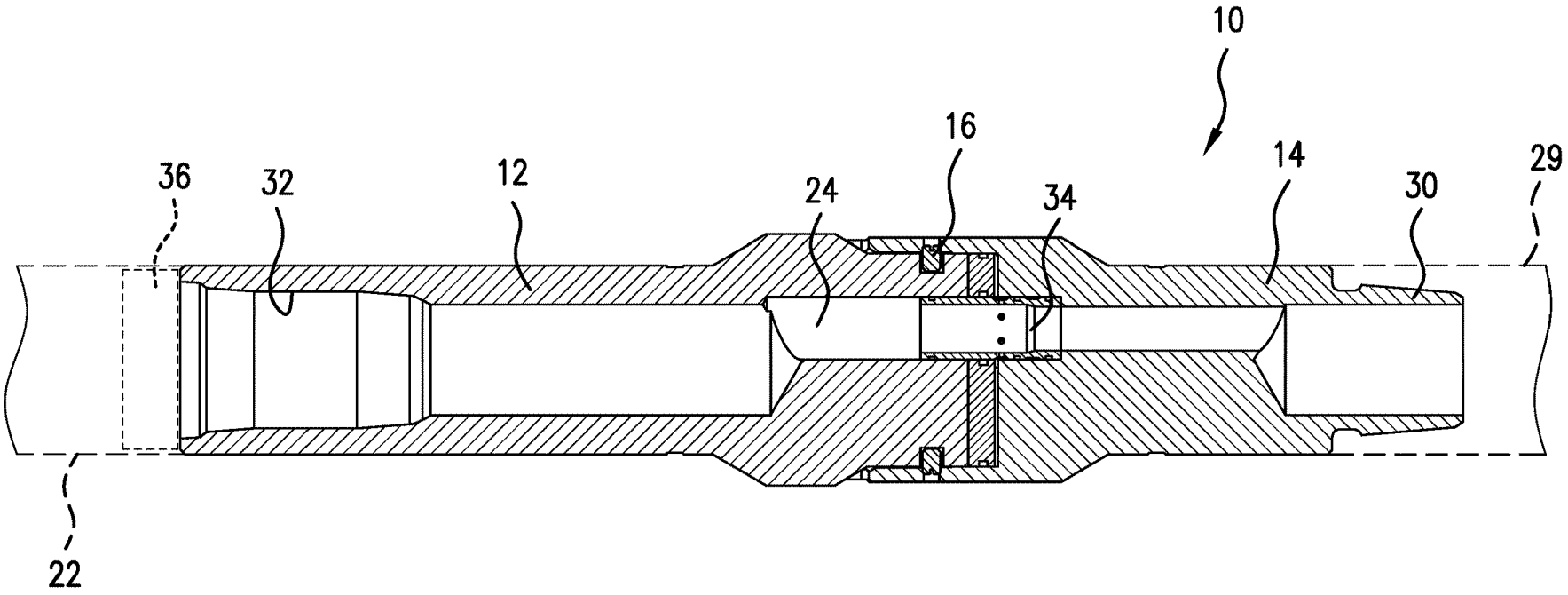
FIG. 1 is a cross-sectional view of a separable tool with mill face as disclosed herein in a run-in condition.
Figure 2:
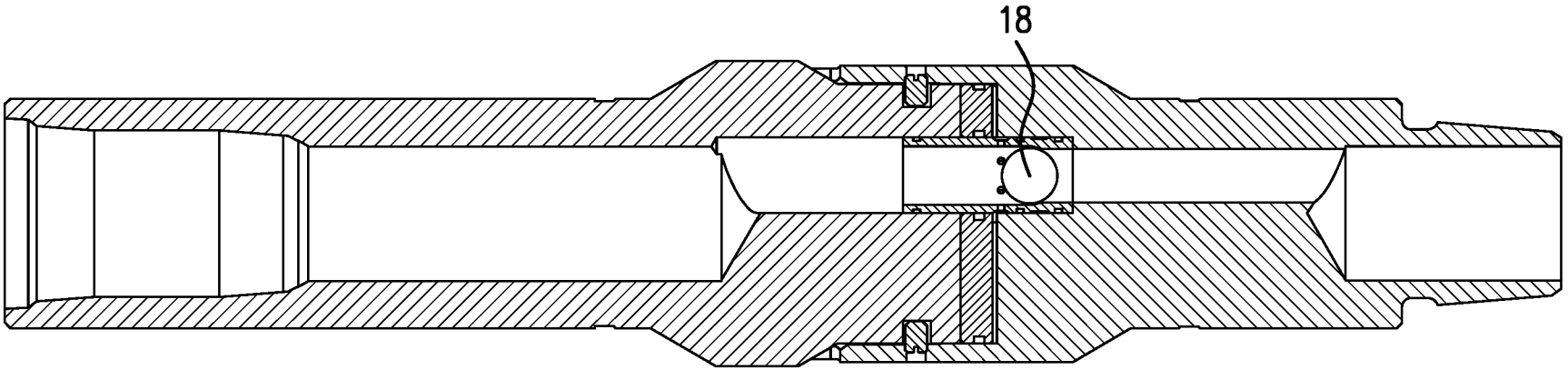
FIG. 2 is the tool illustrated in FIG. 1 with a drop object positioned therein.
Figure 3:
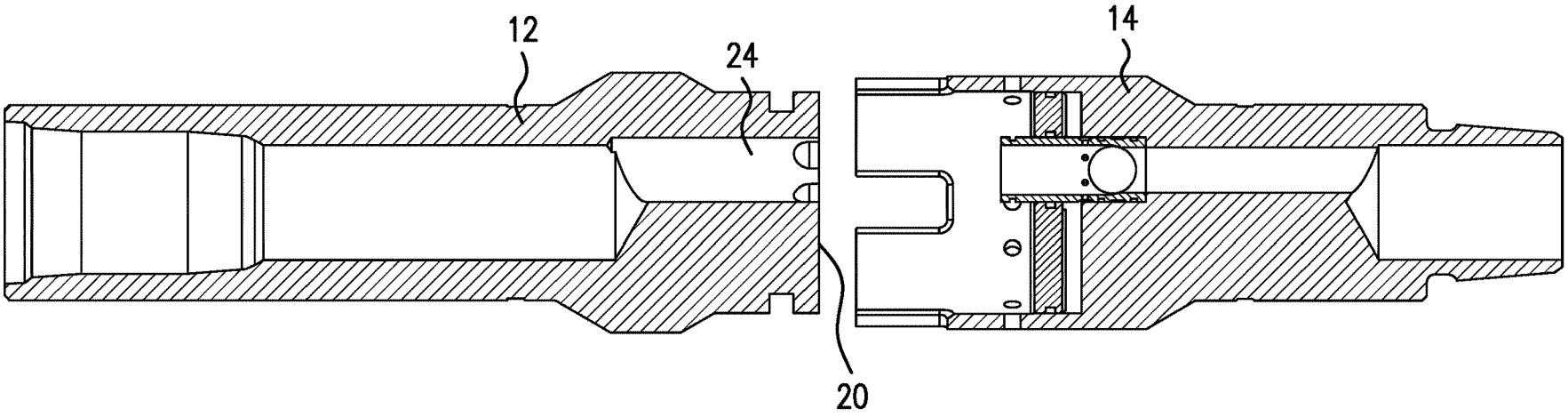
FIG. 3 is the tool illustrated in FIG. 1 in a separated condition.

Referring to FIGS. 1-3, a separable tool 10 includes a mill section 12 and a tool adapter section 14 as a part of a bottom hole assembly (BHA) that also includes some other components. The sections 12 and 14 are initially connected to one another through a release configuration 16. In some embodiments the release configuration will take the form of a number of shear members, such as shear screws as illustrated, but it will be understood that other common release configurations may be substituted such as snap rings, parting rings, rotation based release configurations, torque based release configurations, electrical signal triggered release configurations, etc. In an embodiment as illustrated in FIG. 2, the release configuration is releaseable by application of fluid pressure against a drop object 18 (object 18 visible in FIG. 2). In another embodiment the input for release might be overpull, which is also illustrated in FIG. 2 since the structure of the tool would not need to change. Also, both may be employed in the same tool 10 as is illustrated allowing active selection by an operator. Certain situations might call for one or the other or similar. Any of the other release configuration triggers may also be employed in embodiments.

Upon separation of the mill section 12 from the tool adapter section 14, a mill face 20 (identified in FIG. 3) is exposed and is rotatable from the string 22 uphole thereof or by local rotary machine. Before moving to FIGS. 4 and 5, it is well to note in FIGS. 1-3 that a bore 24 is offset relative to a longitudinal axis of the tool 10. This is important to a subsequent milling operation with the mill face 20 as explained further hereunder.

Figure 4:
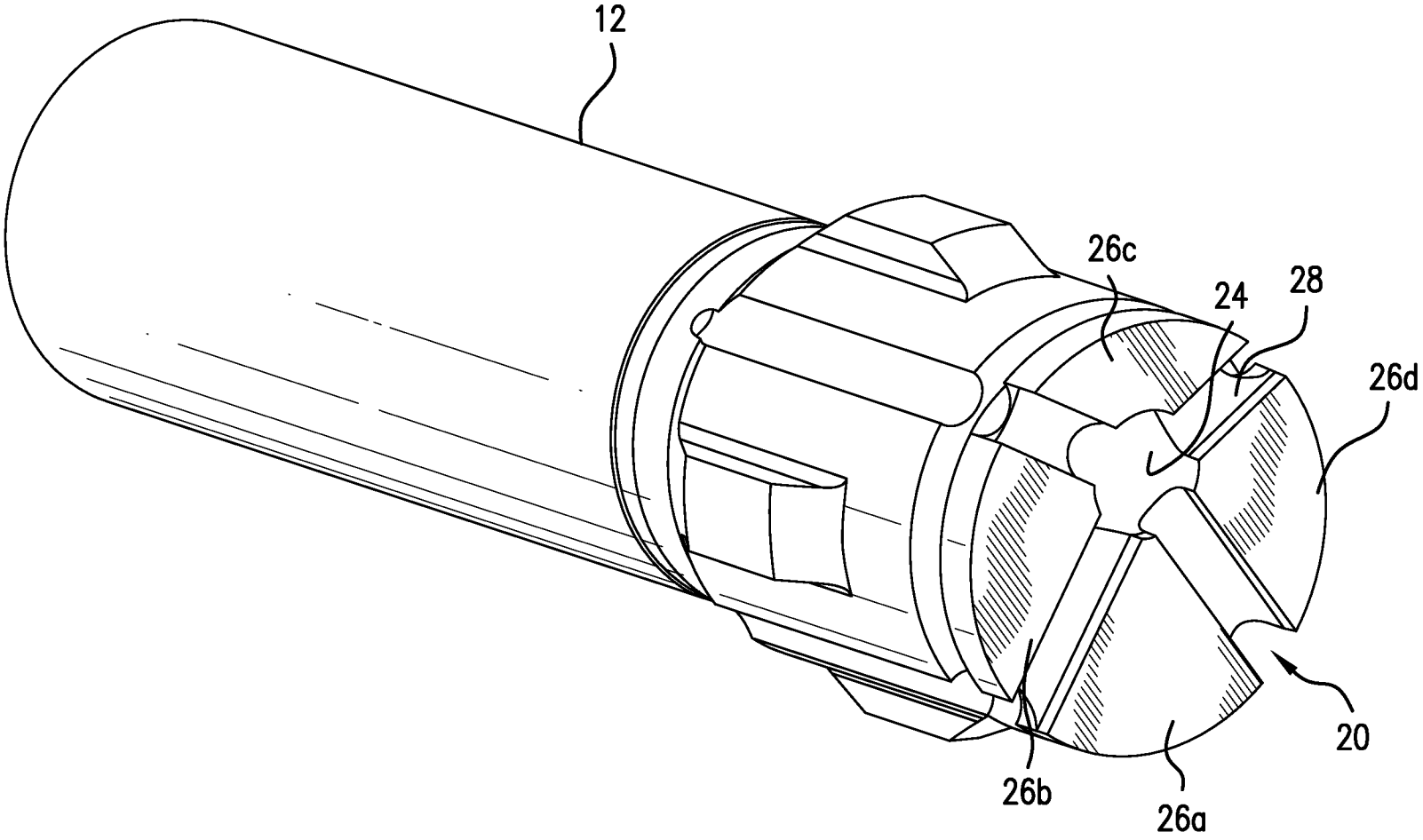
FIG. 4 is a perspective view of a portion of the tool illustrated in FIG. 1, exposing the mill face.
Figure 5:
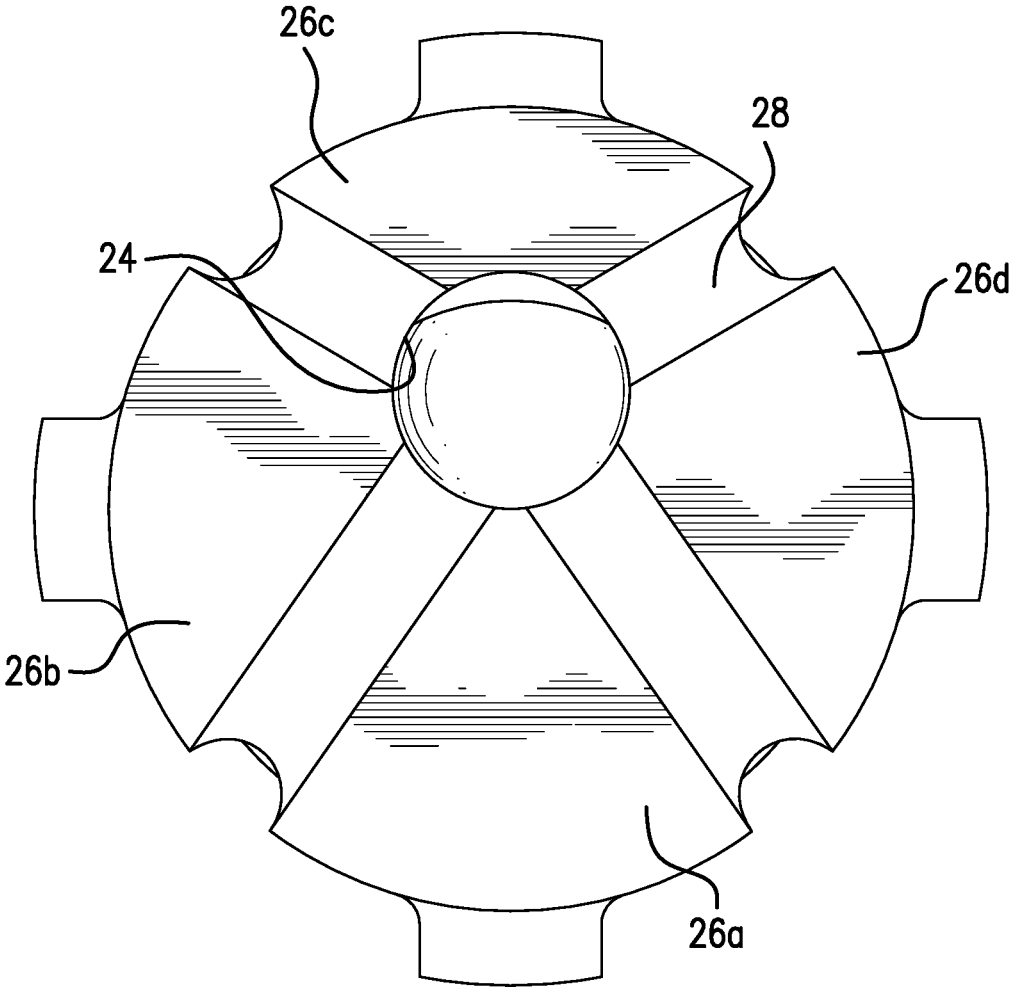
FIG. 5 is an end view of the mill face illustrating an offset bore therein.

Referring now to FIGS. 4-5, the mill face 20 and other features of the mill section 12 are visible. As noted, the bore 24 is offset from a longitudinal axis of the tool 10. This is easily seen in FIGS. 4 and 5. Due to the offset nature of the bore 24, the mill does not core but rather mills flat the entire target to be milled. The mill section 12 rotates about its longitudinal axis which causes the bore 24 to move in a circular manner thereby ensuring no coring action. Therefore, the target surface that is to be milled will indeed be milled flat. It will be appreciated that mill face cutters 26*a-d* may be differently sized and shaped from each other to provide cutting surfaces and junk slots 28 while accommodating the offset bore 24. The junk slots 28 may also extend along an outer peripheral surface of the mill section as shown in FIG. 4. The cutters 26 in an embodiment may comprise superalloy material and are redressable.

One non-limiting example of a particular use of the tool 10, is for a plug and abandon operation that would have taken multiple runs in the prior art. Through the use of the tool 10, the operation can be reduced to a single run. Tool 10 can accomplish several of the actions that would have required independent runs in the prior art. With the tool 10, a run on drill pipe or coil tubing, for example, delivers tool 10 to the target location to set a plug 29 (schematically illustrated with dashed lines in FIG. 1). The plug 29 may be a hydraulic or mechanical plug such as a bridge plug commercially available from Baker Hughes and provides the base for a cement plug to be deposited thereon. The plug is to be attached to tool adapter section 14 at threads 30 at a surface location before the single run that will accomplish the plug and abandon operation in the wellbore. Once the plug 29 is delivered to the target location on the drill or coiled tubing string 22, the plug 29 may be set by known hydraulic or mechanical means. After setting of the plug 29, and depending upon the construction of the tool 10 with object 18 separation or overpull separation or both, the tool 10 is separated at release configuration 16. If this is by object 18, that object will have been dropped from uphole of the tool 10 after the setting of the plug and landed on an object seat 34 in the bore 24. If the separation is by overpull, then that is all that is needed to initiate the separation action.

Upon hydraulic pressure or overpull reaching a design threshold for the release configuration 16 to release, the mill section 12 of the tool 10 separates from the tool adapter section 14 of the tool 10. Once separated, the mill section 12 is pulled uphole from the tool adapter section 14 leaving a space for cement to flow. The amount of space that is created is variable and known to those of ordinary skill in the art since that space would be the same as space created after tagging in a separate cement run of the prior art prior to flowing of cement. While using the tool 10, this does not require a subsequent run but merely the creation of space by pulling the mill section 12 uphole (not out of the hole). At this point, a displacement pill may be pumped to the space through the bore 24 or cement may be pumped to the space without the displacement pill. In either case, the cement is pumped into the space and up and around the mill section 12. Before the cement cures, the mill section 12 is pulled further uphole to avoid becoming stuck in cured cement of the cement plug. The mill section 12 (along with any others components or tools that make up the part of the BHA that has been separated from the tool adapter section 14) is not however pulled out of the hole as would be a cementing tool on a prior art operation. Rather, the mill section 12 need only be pulled uphole enough to clear the cement while curing. Once sufficient time has elapsed for the applied cement to have cured (a time period well known in the industry), the mill section 12 is lowered to tag the now cured cement, pull up slightly to initiate rotation of the mill face 20 (be that by rotation of the string 22 or by other more local means such as a motor) and initiate fluid flow through bore 24. The mill face is then set down to dress the cement plug. Once the cement plug is dressed, weight is slacked onto the cement plug to be sure it holds the design weight, which may be for example, on the order of 20,000 lbs. This operation requires a minimum of three runs, and often four runs, in the prior art while requiring just a single run as taught herein. A reduction in run count of 3 or 4 to 1 is quite significant in terms of time saving and reduced cost associated with the operation.

Additional operations are also supported in a more efficient way through the use of the tool 10 and method hereof. For example, a casing cutter, casing spear, pulling tool, casing anchor, packoffs and casing sealing tools, punch and wash tool, a perf and wash tool, and valves associated with any of these, and combinations of tools including any of the foregoing, etc. may be made a part of the bottom hole assembly (BHA) by being connected between the string 22 and the mill section 12 at thread 32. These optional tools are schematically represented with dashed lines 36 in FIG. 1. With any of these optional tools added to the BHA, yet another trip is eliminated that would have been required in prior art operations. Casing cutting and pulling, punch and wash, perf and wash, packing and sealing, etc. operations are all known in the art and do not require specific discussion thereof other than to note that the additional run usually required can be avoided in combination with the tool 10 as disclosed herein. Additionally, in the event that combinations of tools that are complementary to one another are desired, these can be made a part of the BHA at thread 32 to eliminate their normally separate runs. With these additional tools added to the tool 10, the run count can go from 5 to 1.

Even after-run tools for additional operations have benefits in conjunction with the tool 10 and method disclosed herein because the total number of runs is still reduced by the reductions achieved with the tool 10. These include slot recovery, for example.

Also to be noted is that the tool 10 and its string 22 including any optional tools disposed thereon, may be hung off in the event that other operations require separation of the tstring from surface equipment (e.g. rig, platform, workover unit, etc.).

Figure 6:
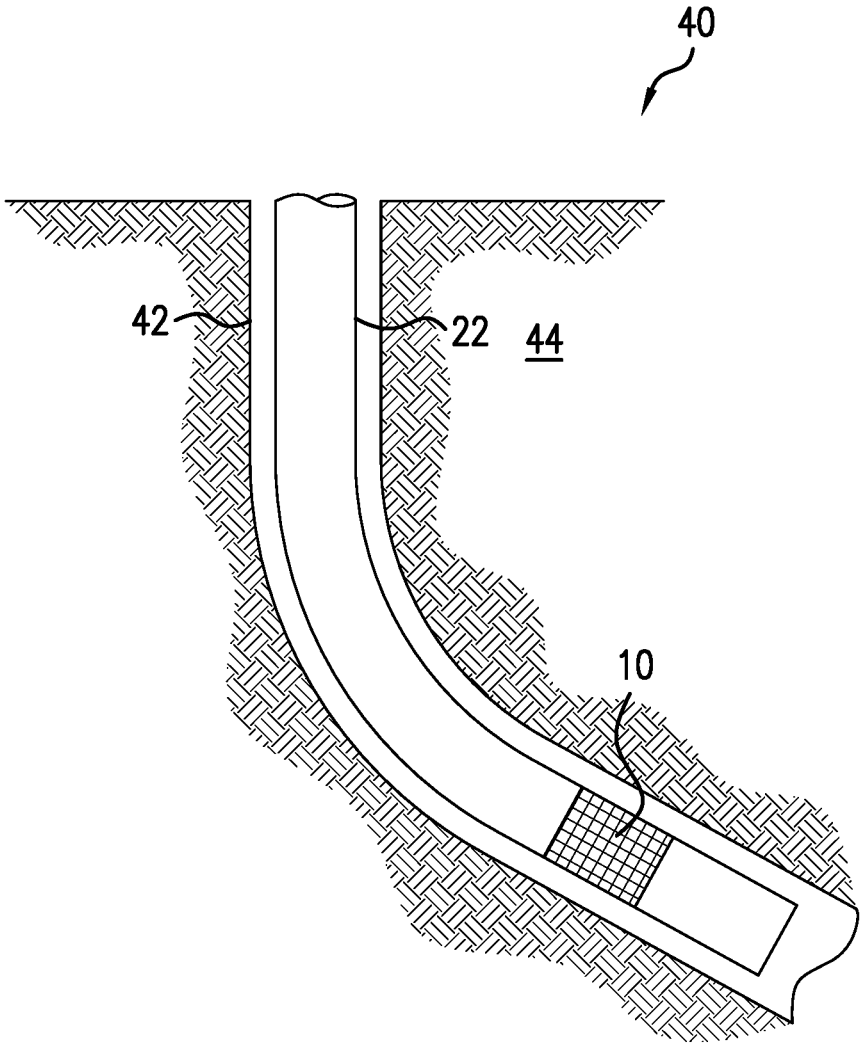
FIG. 6 is a schematic view of a wellbore system having the separable tool with mill face disposed therein.

Finally, referring to FIG. 6, a wellbore system 40 is disclosed. The system 40 includes a borehole 42 in a subsurface formation 44. The string 22 is disposed in the borehole 42 and supports the tool 10 thereon.

Set forth below are some embodiments of the foregoing disclosure:

Embodiment 1: A separable tool including a mill section, a mill face disposed on the mill section and having a bore therethrough that is offset from a longitudinal axis of the mill section, a tool adapter section, and a release configuration releasably securing the mill section to the tool adapter section with the mill face disposed between the mill section and the tool adapter section.

Embodiment 2: The tool as in any prior embodiment, wherein the mill face comprises a plurality of cutters of differing geometry or dimension.

Embodiment 3: The tool as in any prior embodiment, wherein the cutters define junk slots.

Embodiment 4: The tool as in any prior embodiment, wherein the junk slots extend longitudinally along a peripheral surface of the mill section.

Embodiment 5: The tool as in any prior embodiment, wherein the bore includes an object seat.

Embodiment 6: The tool as in any prior embodiment, wherein the release configuration is a shear member.

Embodiment 7: The tool as in any prior embodiment further including one or more of a plug, a casing cutter, a casing spear, a pulling tool, a casing anchor, packoffs and casing sealing tools, a punch and wash tool, a perf and wash tool, and valves associated with any of these, and combinations of tools including any of the foregoing.

Embodiment 8: A method for operating a wellbore system including in a single run, setting a plug in the wellbore system, releasing the plug, pumping cement, dressing the cement, and testing the cement.

Embodiment 9: The method as in any prior embodiment, wherein the releasing the plug is by hydraulic pressure or by overpull.

Embodiment 10: The method as in any prior embodiment, wherein releasing also includes spacing of components of a BHA of which the plug was a part.

Embodiment 11: The method as in any prior embodiment, wherein the pumping includes filling of a space left by the spacing.

Embodiment 12: The method as in any prior embodiment further comprising tagging the cement prior to and after dressing the cement.

Embodiment 13: The method as in any prior embodiment, wherein the testing is setting down weight on the cement.

Embodiment 14: The method as in any prior embodiment, further comprising operating one or more of a casing cutter, a casing spear, a pulling tool, a casing anchor, packoffs and casing sealing tools, a punch and wash tool, a perf and wash tool, and valves associated with any of these, and combinations of tools including any of the foregoing.

Embodiment 15: The method as in any prior embodiment, including deploying a separable tool including a mill section, a mill face disposed on the mill section and having a bore therethrough that is offset from a longitudinal axis of the mill section, a tool adapter section, and a release configuration releasably securing the mill section to the tool adapter section with the mill face disposed between the mill section and the tool adapter section.

Embodiment 16: A wellbore system comprising a borehole in a subsurface formation, a string in the borehole, a separable tool as in any prior embodiment disposed in or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for operating a wellbore system comprising:
setting a plug in the wellbore system;
releasing the plug;
pumping cement;
dressing the cement; and
testing the cement, wherein the setting, releasing, pumping, dressing, and testing are all performed in a single run.

2. The method as claimed in claim 1 wherein the releasing the plug is by hydraulic pressure or by overpull.

3. The method as claimed in claim 2 wherein releasing the plug comprises releasing the plug from a Bottom Hole Assembly (BHA) and spacing the BHA away from the plug.

4. The method as claimed in claim 3 wherein the pumping includes filling of a space left by the spacing.

5. The method as claimed in claim 1 further comprising tagging the cement prior to and after dressing the cement.

6. The method as claimed in claim 1 wherein the testing is setting down weight on the cement.

7. The method as claimed in claim 1 further comprising operating one or more of a casing cutter, a casing spear, a pulling tool, a casing anchor, packoffs and casing sealing tools, a punch and wash tool, a perf and wash tool, and valves associated with any of these, and combinations of tools including any of the foregoing.

8. The method as claimed in claim 1 including deploying a separable tool comprising:
a mill section;
a mill face disposed on the mill section and having a bore therethrough that is offset from a longitudinal axis of the mill section;
a tool adapter section; and
a release configuration releasably securing the mill section to the tool adapter section with the mill face disposed between the mill section and the tool adapter section.

* * * * *